United States Patent [19]

Eckler et al.

[11] Patent Number: 4,927,387

[45] Date of Patent: May 22, 1990

[54] METHOD AND DEVICE FOR CONNECTION TO WIRES IN A FLEXIBLE CABLE

[75] Inventors: Donald F. Eckler, Newark Valley; John R. Mankus, Endicott; Francis J. Ripp, Vestal; George J. Saxenmeyer Jr., Apalachin, all of N.Y.

[73] Assignee: International Business Machines Corporation, Armonk, N.Y.

[21] Appl. No.: 284,577

[22] Filed: Dec. 15, 1988

[51] Int. Cl.[5] ..... H01R 9/07

[52] U.S. Cl. ..... 439/499; 439/493; 29/857; 29/867

[58] Field of Search ..... 439/389–419, 439/492–499, 77; 29/857, 867

[56] References Cited

U.S. PATENT DOCUMENTS

| | | | |
|---|---|---|---|
| 3,102,767 | 9/1963 | Schneck . | |
| 3,601,768 | 8/1971 | Lightner | 439/494 |
| 3,772,775 | 11/1973 | Bonnke et al. | 29/628 |
| 4,083,615 | 4/1978 | Volinskie | 439/498 |
| 4,085,994 | 4/1978 | Volinskie | 339/95 |
| 4,152,826 | 5/1979 | Mueller | 439/498 |
| 4,171,858 | 10/1979 | Knowles et al. | 339/99 |
| 4,212,509 | 7/1980 | Brooks et al. | 339/95 |
| 4,217,022 | 8/1980 | Carre | 339/99 |
| 4,379,361 | 4/1983 | Webster et al. | 29/857 |
| 4,413,872 | 11/1983 | Rudy Jr. et al. | 339/59 |
| 4,415,216 | 11/1983 | Narozny | 439/494 |
| 4,697,862 | 10/1987 | Harircoglu | 439/404 |
| 4,705,482 | 11/1987 | Endo et al. | 439/492 |
| 4,817,281 | 4/1989 | Sugawara | 439/494 |

*Primary Examiner*—David Pirlot

[57] ABSTRACT

A method and connector device for connecting insulated wire cable to another device is provided. The connector device includes a housing having an array of bifurcated connector disposed in a preselected pattern. The cable wires are completely stripped of the insulation at locations corresponding to the pattern of the connectors. The wires are then pushed into the connectors transversely to slidingly and frictionally engage the wires. The wires are pushed into this engagement by a cover which coacts with the housing to insulate the wires and their connectors.

15 Claims, 4 Drawing Sheets

METHOD AND DEVICE FOR CONNECTION TO WIRES IN A FLEXIBLE CABLE

BACKGROUND OF THE INVENTION

1. Field of the Invention

This invention relates generally to connecting of the wires of flat flexible cable to a circuit board, and more particularly to a connector device for use in conjunction with a flat flexible cable which will permit the cable to have the wires stripped and connected by means of the connector device to another device such as a printed circuit board.

2. Prior Art

One of the more common ways of connecting flexible cable to circuit boards or the like is to use connectors which pierce the insulation of the flat flexible cable and after piercing the insulation make contact with the individual wires, each connector contacting a specific individual wire while piercing through the insulation. While this technique is effective in many instances, it does have certain drawbacks in certain instances. Specifically, one of the drawbacks to this method is that often a clean insertion through the insulation is not made with the result that there is some insulation remaining surrounding the wire and interfering with a good electrical connection between the individual wire and the connector. In many applications, this results in an unsatisfactory connection.

Examples of these general types of connectors are shown in the following U.S. Pat. Nos. 4,413,872; 4,212,509; 4,085,994; 4,524,852; 4,697,862; 4,171,858; 3,680,032; 4,037,906; 4,047,785; 3,102,767; 3,772,775; and 4,217,002. However, none of these references teach the connection of stripped wire as provided for in this invention.

SUMMARY OF THE INVENTION

A connection device and method is provided for connecting to the wires of a flexible cable. The insulation is stripped from a portion of the wires and the connection device connects directly to the stripped wires of the flexible cable. The connection device includes a housing which mounts a plurality of electrical connectors having bifurcated ends. The bifurcated ends are disposed and positioned to receive the stripped wires and frictionally engage the wires to make electrical contact.

DESCRIPTION OF THE PREFERRED EMBODIMENT

Figure 3:
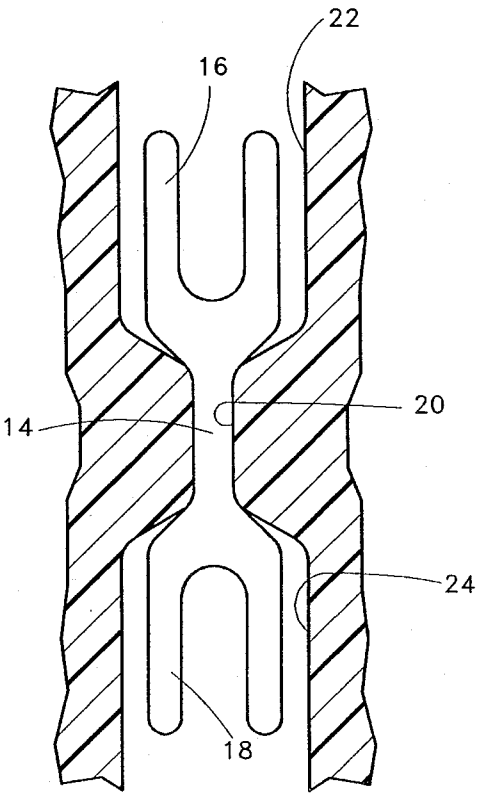
FIG. 3 is a detailed sectional view of one of the electrical connectors of the device of FIG. 2 secured in its slot.
Figure 1:
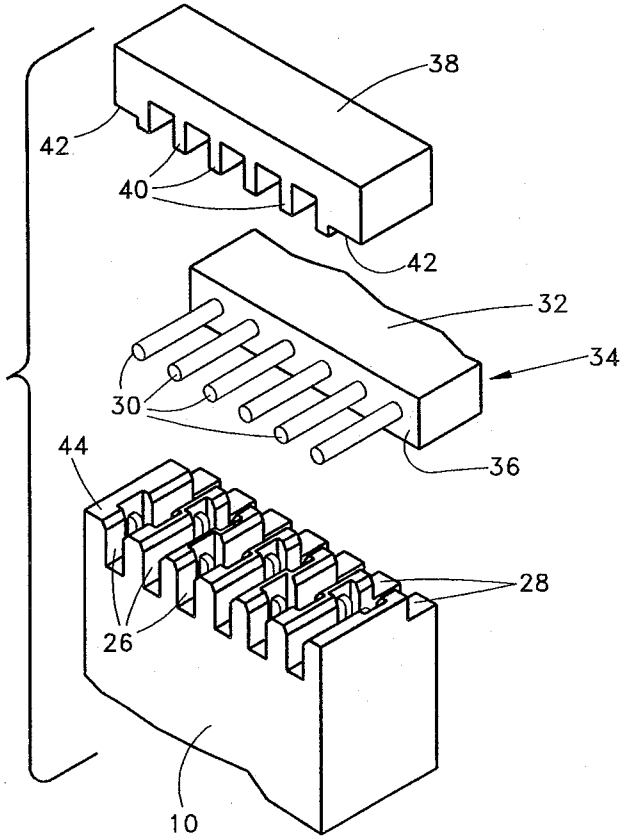
FIG. 1 is an exploded perspective view of one embodiment of a connector device according to this invention used in conjunction with a cable having its wires stripped at the end portion thereof.
Figure 2:
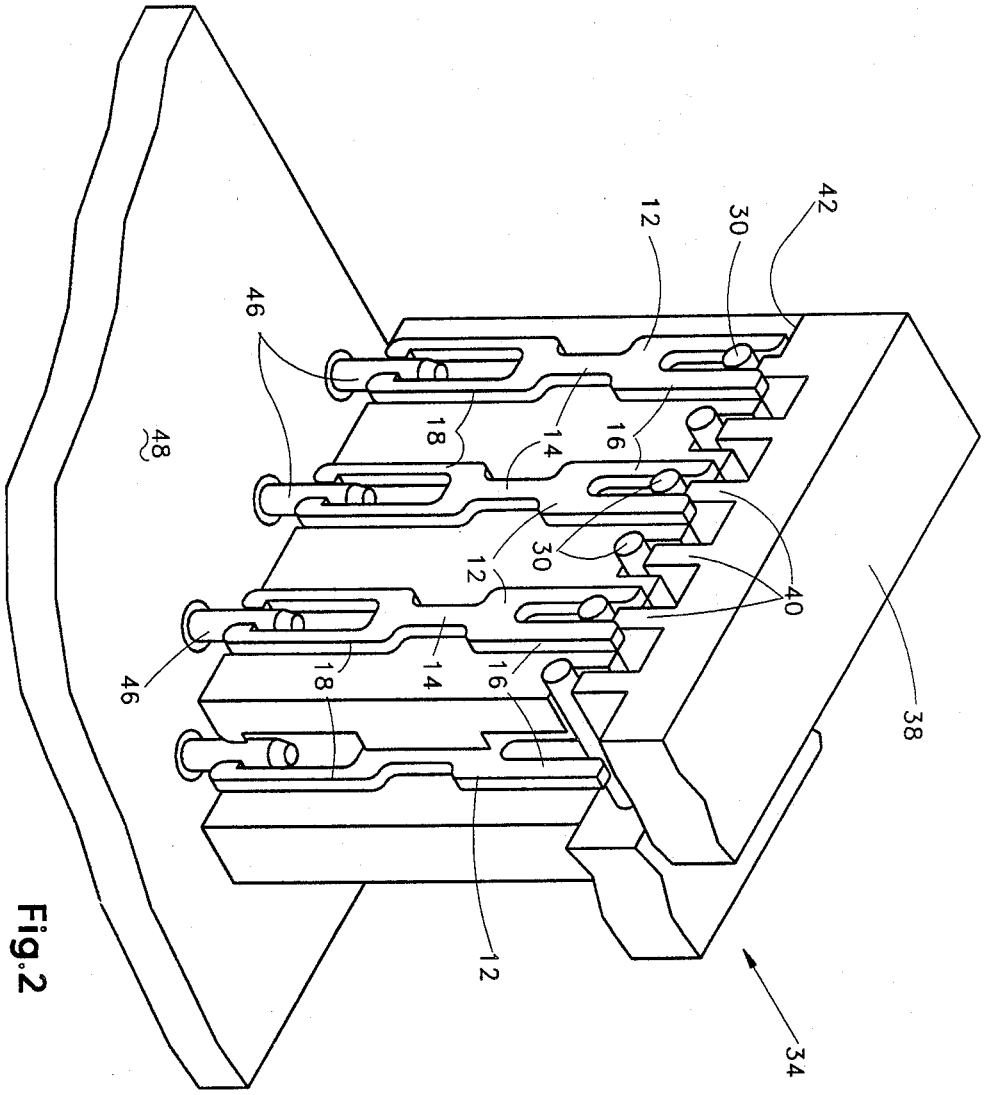
FIG. 2 is a perspective view partially in section of the device of FIG. 1 interconnecting with a cable and the pins of a circuit board.

Referring now to the drawing and for the present FIGS. 1 and 2, one embodiment of the present invention is shown being utilized to connect the wires of a flat flexible cable to the pins of a circuit board. The electrical connector device includes a housing 10 which is molded of an electrically insulating plastic material such as polycarbonate or the like. Molded into the housing 10 are a plurality of electrical connectors 12. Each of the connectors 12 include a necked down central portion 14 and a pair of opposite bifurcated end portions 16 and 18. These connectors are made of any suitable resilient spring material such as beryllium copper. Similar type contacts can be purchased commercially from several different sources including E.I. Du Pont De Nemours & Company. However, for the present invention it is preferred that the end portions 16 be a non-piercing configuration; i.e. not of the type that pierces wire insulation as described above in the prior art. As indicated above, the connectors 12 are molded into the housing 10, each being molded into a slot which roughly conforms in shape to the shape of the connector 12. As can best be seem in FIG. 3, each slot includes a central portion 20 and opposite end portions 22 and 24. The central portion 20 is tightly molded around the central portion 14 of the connector to firmly secure the connector in place, whereas the end portions 22 and 24 are shaped and sized to provide some space between the end portions 16 and 18 respectively of the connector device. This permits the connector 12 to be rigidly held in place by means of the conformity of the central wall 20 of the housing and the central portion 14 of the connector, but allows the bifurcated ends 16 and 18 to flex to thereby engage the wires and pins as will be described presently. At the top end of the housing 20 are formed a plurality of transversely extending slots 26, each slot intersecting one of said connectors 14 and being opened at the top. The housing 10 is also provided with a stepped portion 28 in one face thereof.

The bifurcated ends 16 of the electrical connectors 12 are positioned to coact with laterally spaced wires 30 (preferably copper) extending from the insulating material 32 of a flexible cable 34. The connectors 12 are spaced substantially equal to the spacing between wires 30. As can best be seen in FIG. 1, the insulation has been stripped from the wires 30 in such a way as to provide an essentially flat end face 36 at the end of the insulation 32. This can be done with a conventional stripping tool.

With the wire in this configuration of having the end portion of the wires 30 stripped, the wires 30 are positioned to be inserted into the bifurcated ends 16 of the electrical connectors 12 through slots 26, as shown in FIG. 1, the ends 16 being designed to resiliently engage the bare wires 30.

A cover member 38 also of electrically insulating material, such as polycarbonate, is provided and is molded with ribs 40 extending downwardly therefrom. The ribs 40 conform both in number and position to the slots 26 and as the cover is put in place as shown in FIG. 2, the ribs 40 push the wires 30 into the slots 26 and into engagement with the ends 16 of the connectors 12. As the wires are pushed into the ends 16, a wiping action occurs and contact is made between the wires 30 and the end portions 16 of the connector 12 as shown in FIG. 2. The wires 30 cause the ends 16 to deflect outwardly, the resulting spring forces generated by the ends 16 causing the wires 30 to compress. Also as shown in FIGS. 1 and 2, the end face 36 of the insulation 32 fits into the stepped portion 28 of the housing 10 so as to provide a closed front portion of the housing. The stepped portion 28 of the housing 10 may advantageously be serrated to improve its grip on the cable insulation 32, so providing strain relief; the corresponding portion of the cover member 38 may also advantageously be so serrated as is well known in the art.

As can be seen in FIGS. 1 and 2, the alternate connectors 12 are staggered or offset. This is to allow for proper spacing between the connectors to correspond to the spacing of the wires 30, but still allow connectors of sufficient size (i.e. width) to be utilized; and, if even closer spacing is required, additional staggering of spaced planes could be provided as needed.

The cover also includes flat transverse surfaces 42 which contact complementary end surfaces 44 of the housing 10. The housing 10 and cover 38 are then secured such by adhesively or ultrasonically bonding the surfaces 42 and 44 together to provide an enclosed electrical connection.

The lower bifurcated ends 18 of the connectors are positioned to resiliently engage electrical pins 46 extending from a printed circuit board 48. Thus, a secure electrical connection is provided from each wire in the flexible cable to a particular pin in a circuit board, the connection being a solid, good contact with a stripped bare wire without the possibility of there being insulation or other foreign material surrounding the connector and the wire at its connection.

Figure 6:
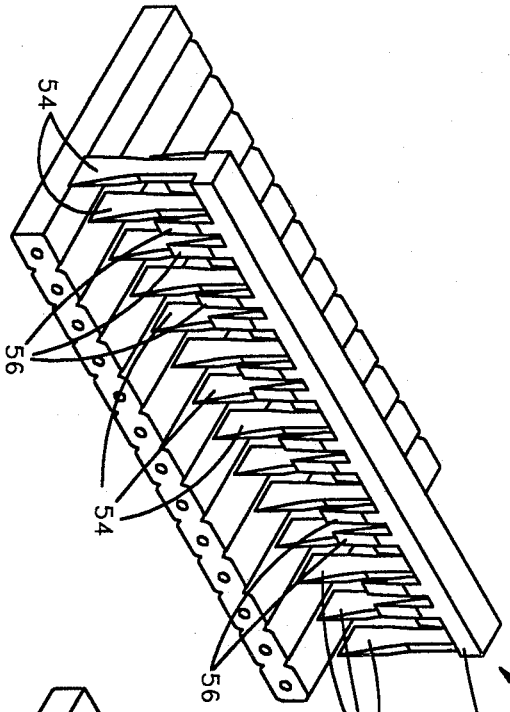
FIG. 6 is a perspective view of a knife showing its use in stripping a cable for use in the embodiment of FIGS. 5 and 6.
Figure 4:
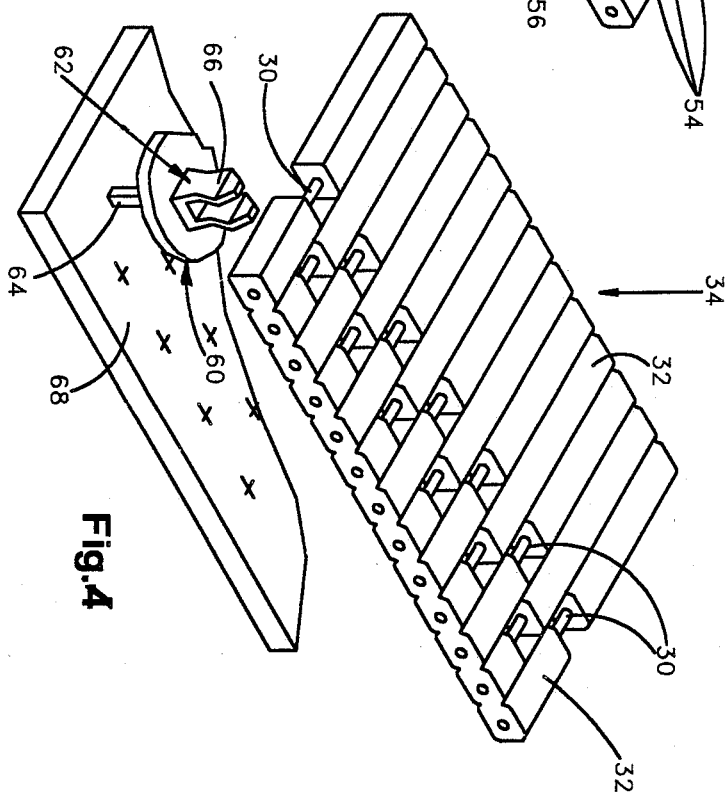
FIG. 4 is a perspective view of a stripped cable and a portion of a connector device for the reception of the cable of another embodiment of this invention.
Figure 5:
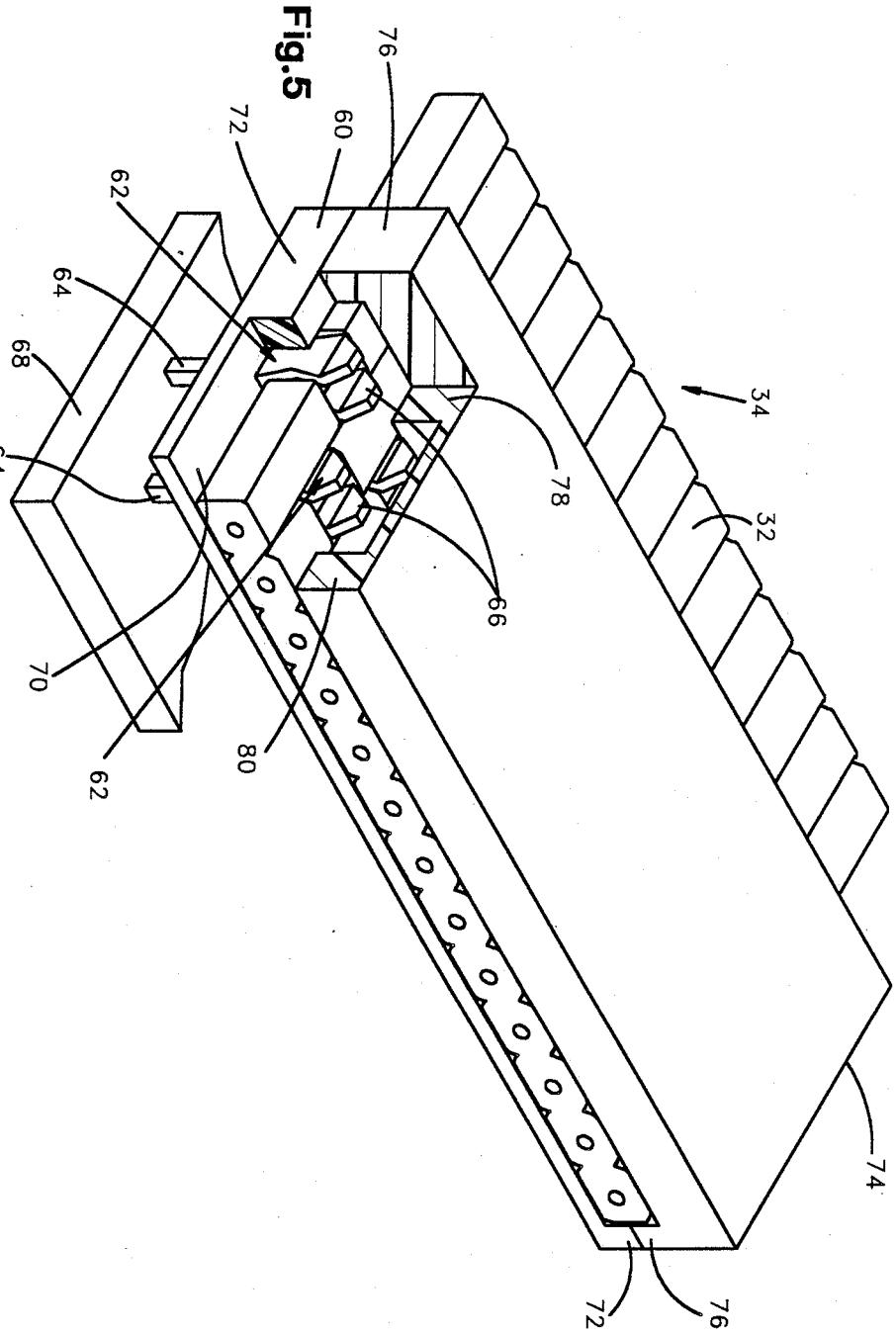
FIG. 5 is a perspective view partially in section with parts broken away of the cable and connector device of FIG. 4 assembled.

Referring now to FIGS. 4 and 5 another embodiment of this invention is shown. This embodiment is similar to the embodiments of FIGS. 1 through 3 except the insulator is not completely stripped from the end of the wire, but rather is partially stripped and removed as shown in FIG. 4. As seen in FIG. 4 the cable 34 has the insulation 32 stripped and partially pulled from the end thereof to leave a castellated configuration with bare wires 30 exposed in a staggered fashion. The stripping can be accomplished by means of the stripping tool 50 shown in FIG. 6. The tool 50 has a handle 52 from which a series of longitudinal blades 54 and transverse blades 56 depend. The transverse blades 56 are arranged in pairs between each pair of longitudinal blades 54 to straddle the wires 30. The tool is pushed onto the cable 34, with the longitudinal blades 54 slicing completely through the insulator 32 between the wires 30, and the transverse blades cutting completely through the insulator 32 between the wires 30. When the cut is made, the cable is pulled away from the knife, tearing the remaining insulation to form the configuration shown in FIG. 4.

As shown in FIG. 5 a somewhat modified housing and connection configuration is utilized in this embodiment. The connection device includes a housing member 60 which mounts connectors 62 which are modified somewhat from those of the previous embodiment. In this case, each of the connectors 62 include a stem portion 64 and a bifurcated upper portion 66. The stem portion 64 is mounted in and depends from the housing 60, and is adapted to be soldered to a substrate 68 as shown in FIGS. 4 and 5. The bifurcated portions of the connectors 12 extend upwardly from an upper flat face 70 on the housing bounded by end walls 72. As is the previous embodiment the connectors 62 are in a staggered configuration.

A cover member 74 is provided which has end walls 76 and a pair of transversely extending ribs 78 and 80. The castellated wire is positioned over the connection, with the exposed bare wires 30 aligned with the connection 62. The cover is used to push the wires 30 into the connection by means of the ribs 78 and 80 pushing against the insulation 32 of the cable 34. The end walls 72 and 76 of the housing and cover can then be bonded as previously described. In this embodiment, the ends of the connectors 64 are soldered or otherwise bonded to the substrate 68.

While several embodiments of this invention have been shown and described, various adaptations and modifications can be made without departing from the scope thereof as defined in the appended claims.

What is claimed is:

1. A method of connecting the wires in a flexible cable wherein the wires are laterally spaced within an insulating coating to a connector device having a plurality of connectors each having a bifurcated end portion adapted to transversely engage the wires for electrical contact comprising the steps of:

arranging said connectors in said device in a preselected pattern disposed to receive the wires therein;

stripping the insulation completely from selected portions of each of said wires in said cable in a pattern which corresponds to the pattern of arrangement of said connectors while maintaining the stripped portions of the wires essentially co-planer and axially parallel; and thereafter forcing said stripped wire portions transversely into engagement with said connectors with the wires remaining essentially co-planer and parallel;

whereby connection of pre-exposed bare wires is made to connections in a preselected pattern in a sliding manner.

2. The method as defined in claim 1 wherein the connectors are axially offset with respect to each other.

3. The method as defined in claim 1 wherein the exposed bare wires are disposed at the end of the cable with insulation extending only one direction axially therefrom.

4. The method as defined in claim 1 wherein the exposed bare wires are disposed with insulation extending in both directions axially therefrom.

5. The method as defined in claim 1 wherein said connection device includes a housing mounting said connectors, and a cover member, and wherein said cover member forces said wires into said connectors and thereafter coacts with the housing to provide insulation for said bare wires in said connectors.

6. The method as defined in claim 3 wherein said connector device includes a plurality of electrically insulated channels each having a connector disposed therein and adapted to receive one of said bare wires.

7. In combination a wire cable having a plurality of laterally spaced wires within an insulating coating and a connection device for electrically connecting said wires to a substrate, the improvement comprising, said cable having the insulation completely stripped from a portion of each of said wires to provide a pattern of exposed bare wires the stripped portions of each of said wires being essentially co-planar and axial parallel to each other, said connection device including a housing member and a cover member each formed of insulating material, housing member mounting a plurality of connectors each having bifurcated end portions and arranged in a pattern corresponding to the pattern of said bare exposed wires to each transversely engage one of said exposed bare wires;

said cable being engaged by said housing with each of said connectors transversely and frictionally engaging one of said bare exposed wires with the bare wires being maintained substantially co-planer and axially parallel; and said cover member including means to coact with said cable to maintain said wires in engagement with said connectors;

said housing member and said cover member being configured to coact with said insulation to insulate said exposed bare wires and their connectors.

8. The combination as defined in claim 7 wherein said wires are stepped at the end of said cable with insulation extending only one direction axially therefrom.

9. The combination as defined in claim 8 wherein said housing includes a plurality of electrically insulated channels in which said bare wires are disposed.

10. The combination as defined in claim 9 wherein said housing includes a stepped portion defining a face on said housing, and wherein the end of the insulation adjacent said exposed bare wires is disposed on said stepped portion abutting said face of said housing.

11. The combination as defined in claim 7 wherein said exposed bare portion of each wire has insulation extending axially in both directions therefrom.

12. The combination as defined in claim 7 wherein adjacent bare exposed wires are axially displaced with respect to each other, and said connectors are correspondingly displaced with respect to each other.

13. The combination as defined in claim 7 wherein adjacent connectors are axially displaced with respect to each other.

14. The combination as defined in claim 7 wherein said housing member and said cover member include grip enhancing means coactable with said cable insulation.

15. The combination as defined in claim 14 wherein said grip enhancing means includes serrations.

* * * * *